US006553703B2

(12) United States Patent
Fowler et al.

(10) Patent No.: US 6,553,703 B2
(45) Date of Patent: Apr. 29, 2003

(54) INFORMATION PANEL ATTACHABLE TO VEND MACHINE SPIRALS

(75) Inventors: Douglas Gee Fowler, Plano, TX (US); Stephen Springfield, McKinney, TX (US)

(73) Assignee: Recot, Inc., Pleasanton, CA (US)

( * ) Notice: Subject to any disclaimer, the term of this patent is extended or adjusted under 35 U.S.C. 154(b) by 0 days.

(21) Appl. No.: 09/829,240

(22) Filed: Apr. 9, 2001

(65) Prior Publication Data

US 2002/0148150 A1 Oct. 17, 2002

(51) Int. Cl.[7] ..... G09F 3/16

(52) U.S. Cl. ..... 40/666; 221/2; 221/6; 221/75

(58) Field of Search ..... 40/316, 584, 658, 40/666; 221/2, 6, 75

(56) References Cited

U.S. PATENT DOCUMENTS 1,157,195 A * 10/1915 Ulrich ..... 40/658
1,700,977 A * 2/1929 Butler ..... 40/666
2,038,029 A * 4/1936 Doebert ..... 40/666
2,470,811 A * 5/1949 Engleman ..... 40/658
2,535,262 A * 12/1950 Brownsey ..... 40/340
3,107,449 A * 10/1963 Deitesfeld ..... 40/584
3,828,971 A * 8/1974 Offutt et al. ..... 221/75
3,840,147 A * 10/1974 O'Neal et al. ..... 221/75
3,861,561 A * 1/1975 Wittern et al. ..... 221/75
3,999,682 A * 12/1976 Albright et al. ..... 221/75
4,286,358 A * 9/1981 Levin ..... 24/67 R
4,312,460 A * 1/1982 Boettcher ..... 221/75
4,821,437 A * 4/1989 Abramson et al. ..... 40/658
5,186,355 A * 2/1993 VonDelinde et al. ..... 221/75
5,863,019 A * 1/1999 Rose et al. ..... 248/205.3

* cited by examiner

*Primary Examiner*—J. J. Swann
*Assistant Examiner*—Andrea Chop
(74) *Attorney, Agent, or Firm*—Colin P. Cahoon; Carstens, Yee & Cahoon, LLP

(57) ABSTRACT

An information panel that is easily installed on a vending machine spiral in order to identify the product associated with the spiral. The invention comprises a convex channel, that nests with the concave surface at the end of a vending machine spiral, and a graphics surface integral to the convex channel and oriented in the vertical plane for viewing by a consumer of the vending machine. The invention can also incorporate a prior art kicker.

7 Claims, 5 Drawing Sheets

INFORMATION PANEL ATTACHABLE TO VEND MACHINE SPIRALS

BACKGROUND OF THE INVENTION

1. Technical Field

The present invention relates to a device installed on vending machine spirals that provides for a graphics presentation, to the consumer and the person restocking the machine, at the discharge end of the vending spiral. The invention can be incorporated with a kicker feature such as used in the prior art.

2. Description of Related Art

Vending machines for snack food products, such as that illustrated in FIG. 1, are commonly used to distribute snack food packages to consumers. As shown in FIG. 1, such vending machines (or, as sometimes referred to herein as "vend" machines) use a mechanically driven spiral device 102 to deliver a selected product onto a consumer pick-up shelf (not shown). In operation, the consumer inserts currency into the machine and selects the product to be purchased from a specific vend machine spiral 102. This spiral then rotates axially 360°, thereby pushing the product, such as a bag of potato chips 104, towards a gap between the spiral 102 and a display window 106. Product 104 subsequently falls through this gap and onto the consumer pick-up shelf for retrieval by the consumer.

The vending machine is typically restocked by opening the front of the machine such that the display window 106 swings away from the spirals 102 to allow access to each of the spirals 102. The vending machine is then manually restocked by placing a product, such as potato chip bags 104, in the slots provided by each exposed turn of the spiral 102.

One of the frequent problems associated with the manual restocking of vending machine is the inconsistency of the stocking process. There is presently very little assurance that the person stocking the machine will place the appropriate product in the appropriate spiral. In fact, in the past Applicants have experienced roughly a 30% fulfillment rate of properly restocked product. This can be particularly problematic when it is desirable to introduce a new product into the vending machine, one which the person restocking the vending machine may not be familiar with. Instead, the person restocking the machine may stock the empty spiral with a familiar product, knowing that it is popular with consumers.

Better control of the restocking process could provide much greater inventory controls, assist with targeted marketing efforts, and insure that the appropriate variety of product is offered to the consumer, thereby potentially increasing overall sales. Guess work and discretion on the part of the person restocking the machine needs to be limited to allow the product supplier both improved influence over product distribution and more accurate feedback on consumer preferences.

Consequently, a need exists for a method or device to provide for consistent inventory control during the restocking process of vending machines. A solution to this problem should be inexpensive, easily adaptable to existing vending machines, and, ideally, provide for additional marketing presentation as a secondary use. At the same time, such solution should not detract from the presentation of the product 104 through the vending machine display window 106.

SUMMARY OF THE INVENTION

The proposed invention comprises an integral piece that attaches to the distribution end of a vending machine spiral and provides a graphics surface to identify the product that should be inserted in a respective spiral. Such device utilizes a convex channel that mates with the concave interior surface of the end of the spiral. A graphics surface or panel extends horizontally from such convex channel, thereby providing a means for identifying the product that should be installed in such spiral. The invention can further incorporate a prior art kicker extension perpendicular from the graphics panel.

The invention is inexpensive to manufacture and is easily installed on existing vending machines. In addition, the invention allows for the presentation of marketing or promotional information while not detracting from the presentation of the product through the vending machine display window.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
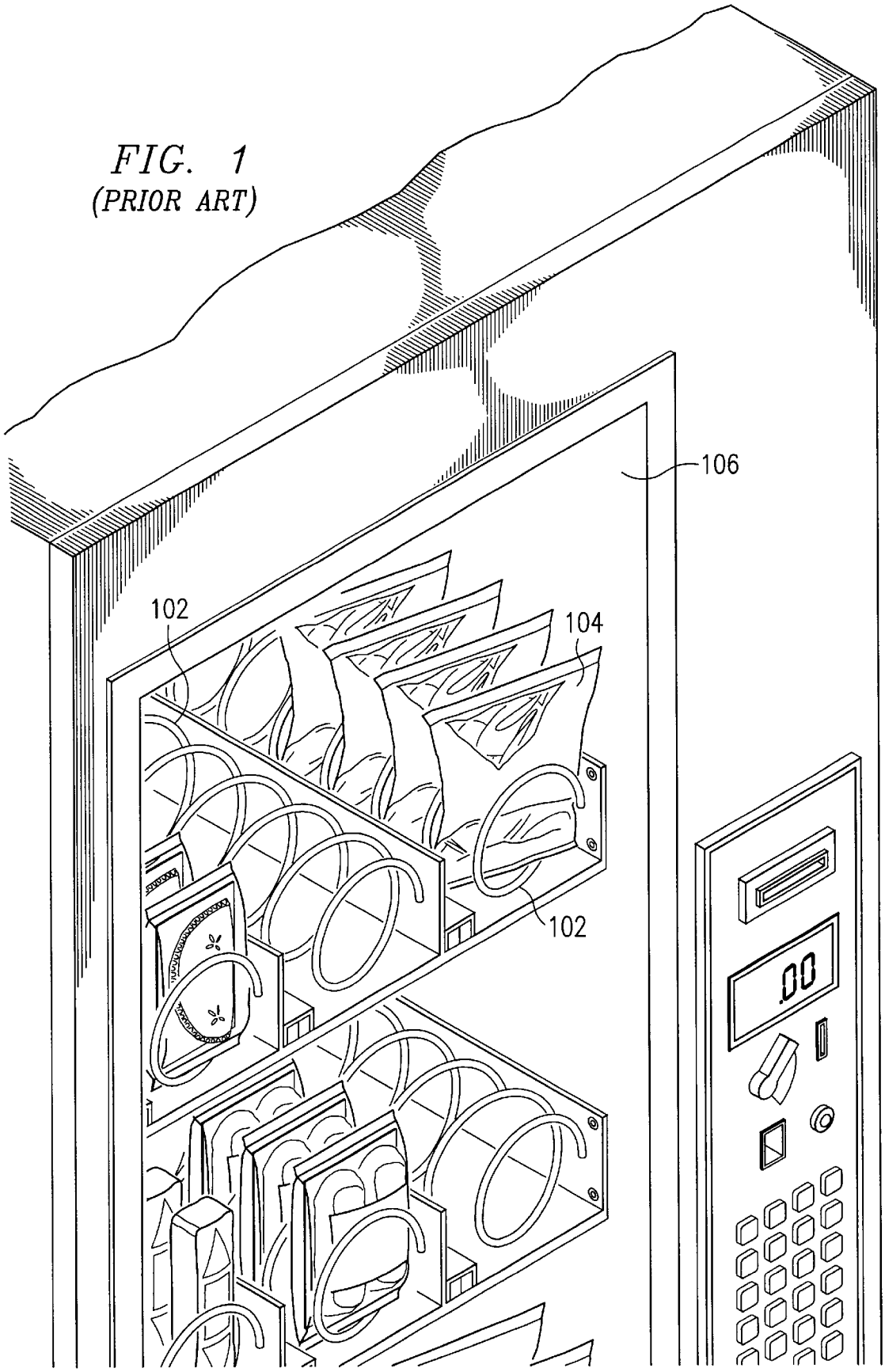
FIG. 1 (PRIOR ART)
FIG. 1 is a perspective view of a prior art vending machine.
Figure 2A:
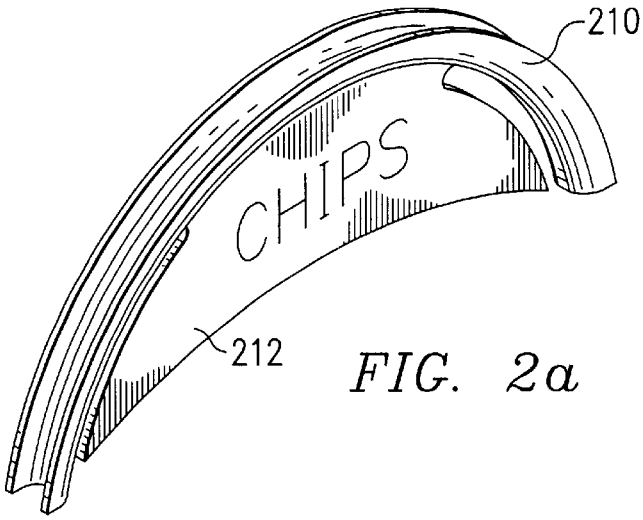
FIGS. 2*a*, 2*b*, and 2*c* are a perspective view, front view, and bottom view, respectively, in elevation of one embodiment of the present invention.
Figure 2B:
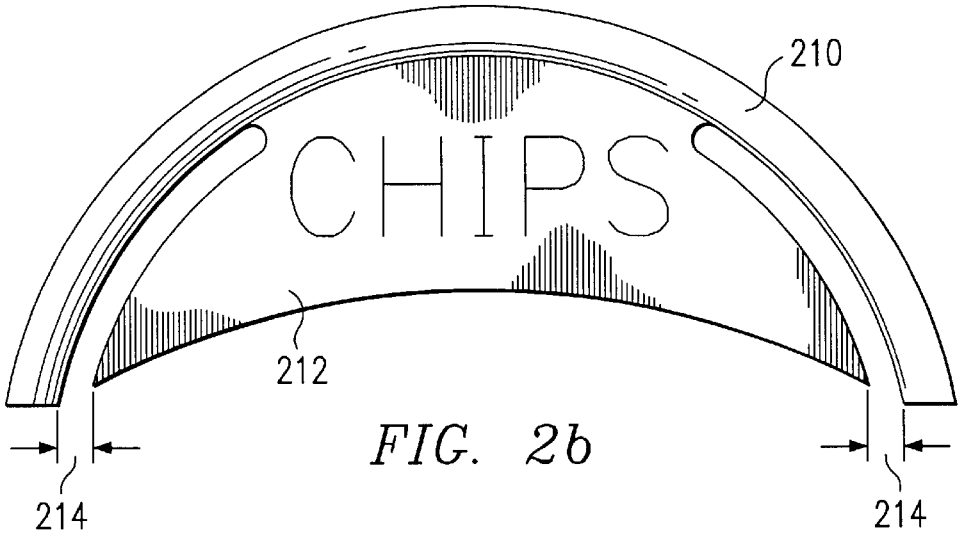
Figure 2C:
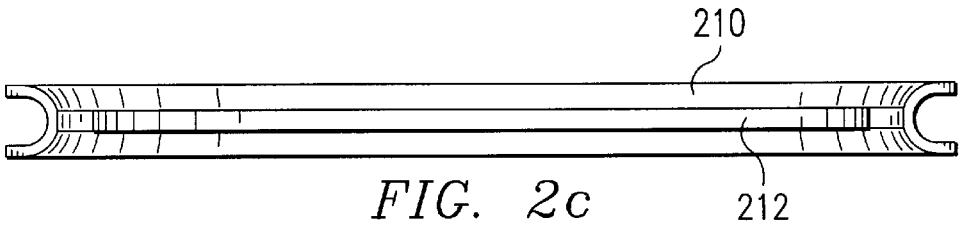

FIGS. 2*a*, 2*b*, and 2*c* show one embodiment of the present invention. This embodiment comprises a convex channel 210 integral with a graphics surface or panel 212. The convex channel 210 provides a means for snapping the invention onto the concave, or interior, side of a vend machine spiral towards the end of said spiral. The graphics panel 212 then provides a surface on which a product identifying trademark, picture, or other marketing presentation can be displayed.

As is clearly seen from FIG. 2*b*, there is a gap 214 located on either side of the integral interface between the convex channel 210 and the graphics panel 212. The width of the integral interface between the graphics surface 212 and the convex channel 210 is therefore less than the width of the graphics surface 212. The gaps 214 are provided in order to allow flexibility in the device which, although may be most inexpensively manufactured as a flat or planar piece, must be attached to the slight curvature of the spiral along the convex channel 210. The added flexibility provided by these gaps 214 reduces the incidence of the device becoming disengaged or falling off from the associated spiral.

It is anticipated that the invention illustrated in FIGS. 2*a*, 2*b*, and 2*c*, as well as described in alternative embodiments below, can be manufactured of any material that allows for some flexibility in order to snap onto the spiral and maintain its position. The device should also be easy to remove, so that the various spirals can be quickly relabeled, as will be described in more detail below. The preferred embodiment of the invention utilizes a polymer or plastic material, such as PET (polyethylene terephthalate), but it should be understand that the device could also be manufactured from a metal or other suitable substance.

Figure 3A:
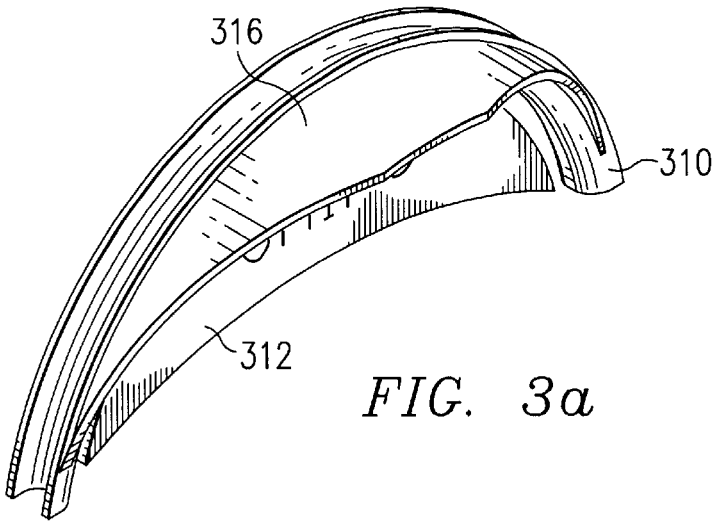
FIGS. 3*a*, 3*b*, and 3*c* are a perspective view, front view, and bottom view, respectively, in elevation of an alternative embodiment of the present invention.
Figure 3B:
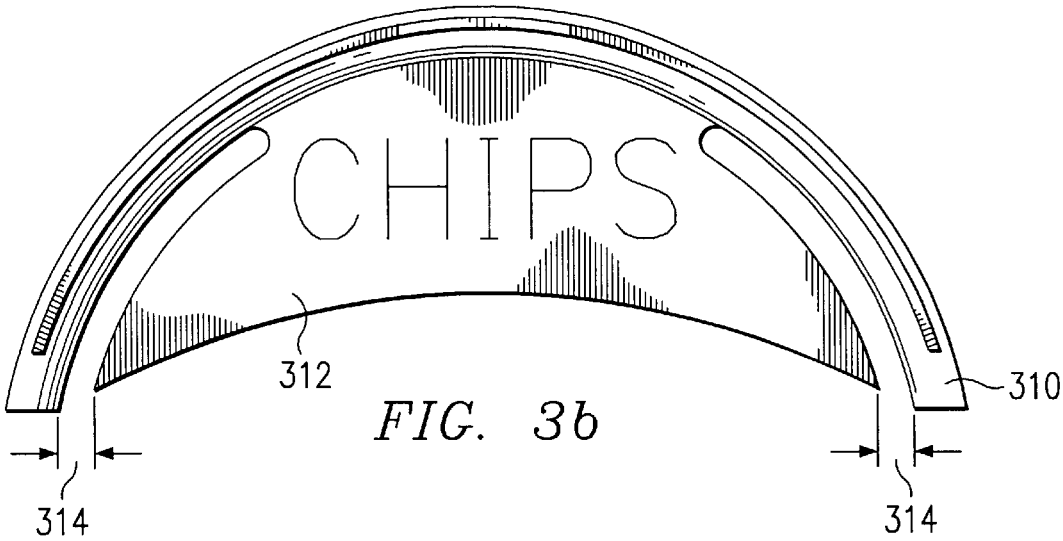
Figure 3C:
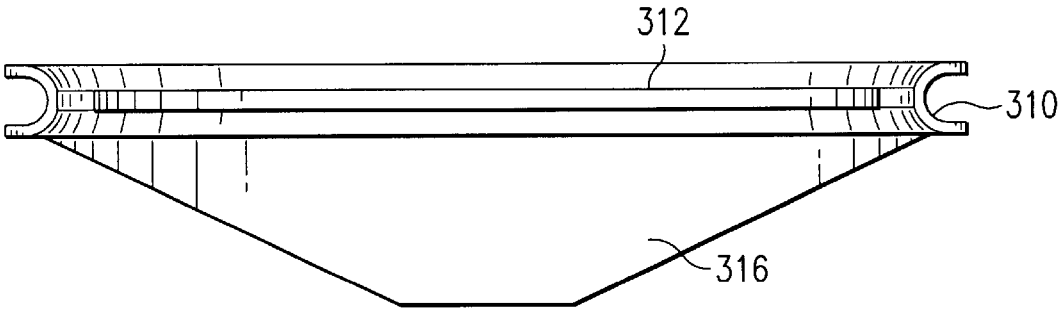

FIGS. 3*a*, 3*b*, and 3*c* illustrate an alternative embodiment of the present invention. This alternative embodiment likewise comprises a convex channel 310 and a graphics surface or panel 312 integral thereto. Again, gaps 314 on either side of the integral interface between the convex channel 310 and the graphics panel 312 provide for flexibility during installation and use of the device. The embodiment illustrated in FIGS. 3*a*, 3*b*, and 3*c* farther incorporates a prior art kicker 316, which is a lip 316 that extends approximately perpendicular to the graphics panel 312 and is likewise attached to and integral with the convex channel 310. As is known in the prior art, this kicker 316 provides a means for pushing the product towards the opening or gap between the vend machine spiral and the display window on the front of the vending machine, such that the product is more likely to be deposited in the consumer pick-up shelf.

Figure 4:
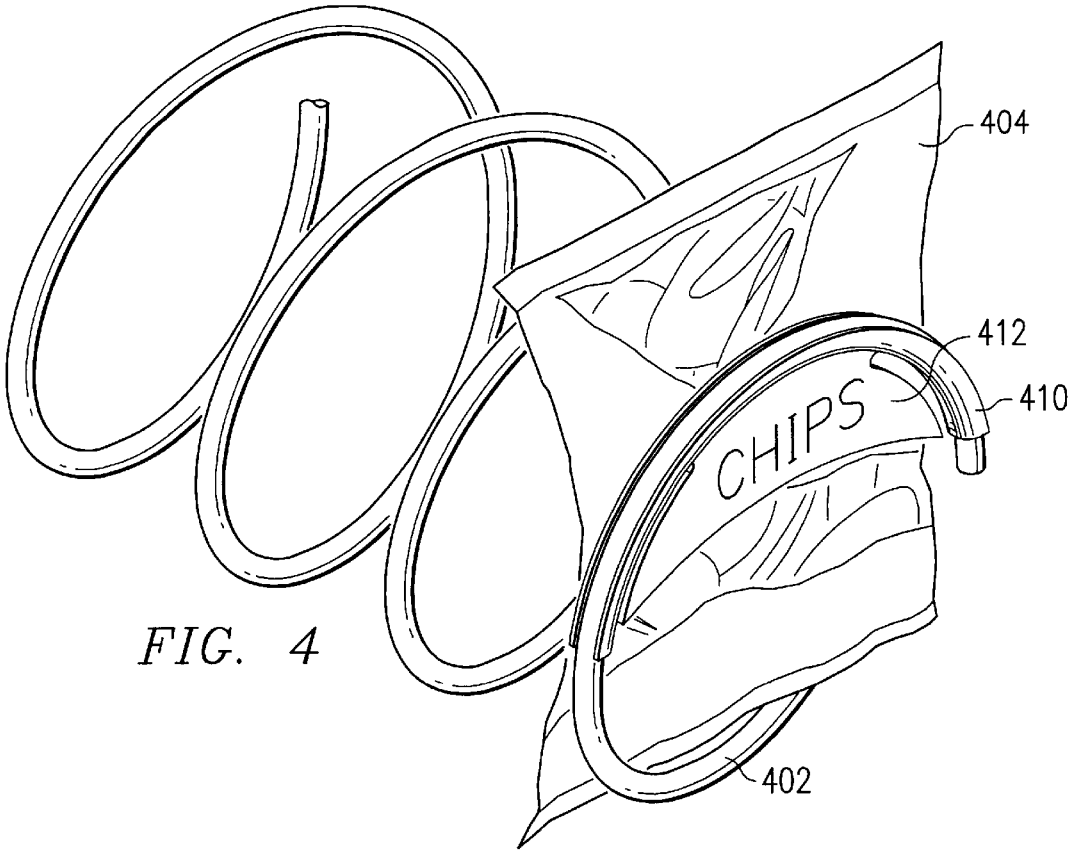
FIG. 4 is a perspective view in elevation of a portion of a vend machine spiral with one embodiment of the present invention installed.
Figure 5:
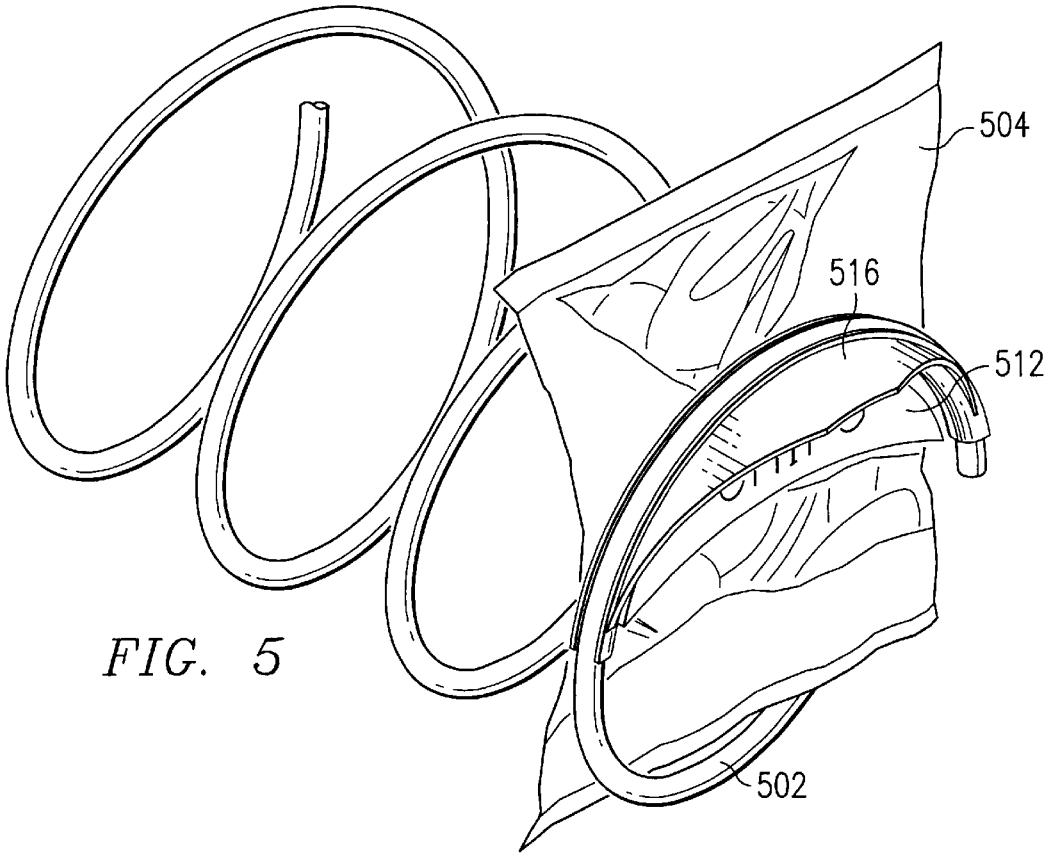
FIG. 5 is a perspective view in elevation of a portion of a vend machine spiral with an alternative embodiment of the present invention installed.

FIGS. 4 and 5 illustrate the two previously-described embodiments of the present invention attached to a vend machine spiral. As can be seen in FIG. 4, the convex channel 410 is nested with the end of the spiral 402. The graphics panel 412 is thereby oriented such that both the consumer and the person restocking the spiral can easily view the text or graphics presented thereon. Any number of shapes can be used for the graphics panel 412. Preferably, however, the graphics panel 412 should not be so large as to obscure the graphics presentation of the product 404 located in the spiral 402.

Likewise, FIG. 5 shows the alternative embodiment of the invention incorporating a kicker 516 installed on a spiral 502. It should be noted that the kicker 516, which is perpendicular to the graphics panel 512, is oriented towards the front of the spiral, or closest to the display window. As is known in the prior art, this allows the kicker to push the product 504 away from the spiral when dispensing the product 504.

Figure 6:
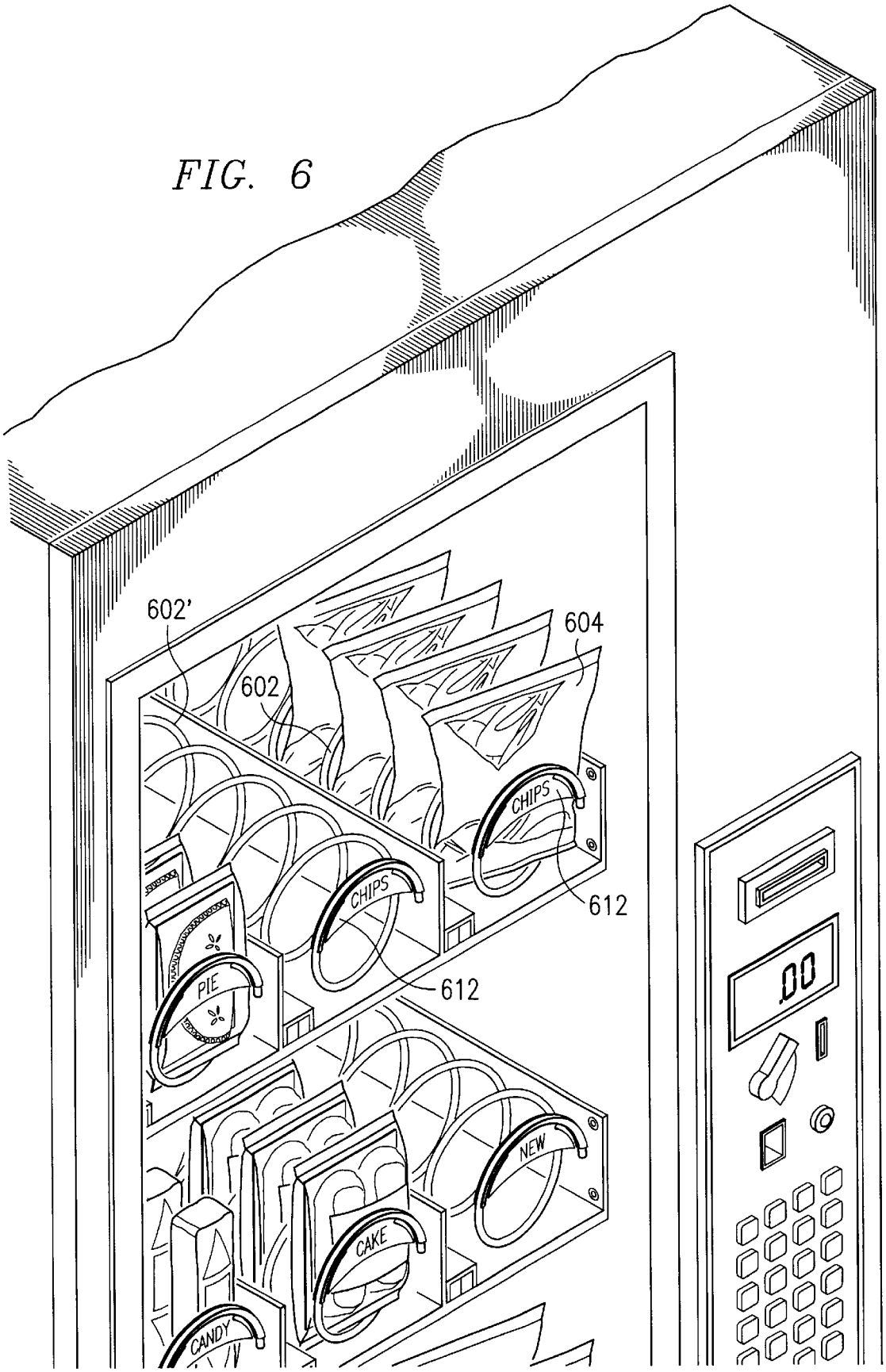
FIG. 6 is a perspective view of a prior art vending machine with one embodiment of the invention installed.

FIG. 6 shows the installation of one embodiment of the present invention on a prior art vending machine. It can be seen that the graphics presentation 612 can provide marketing information that can be combined with the graphics on a product 604 when viewed by the consumer prior to purchase. For example, a textual message such as "NEW" or "SPICY" could be printed on the graphics surface 612 in order to draw attention to a specific product. The graphics surface 612 could also have a product trade name or trademark displayed in combination with other marketing information. The graphics panel 612 thereby not only identifies which product should be stocked in an empty spiral 602', but can enhance the presentation of product 604 located in a spiral 602 that contains product. With a product trade name located on the graphics panel 612, a person restocking an empty spiral 602' can easily determine what product is to be placed in such spiral 602', and is more likely to restock the machine as the operator of the machine intends. Also, the device is easily removed so that individual spirals can be relabeled with ease.

The invention provides for an inexpensive add-on to existing prior art machines which greatly enhances the control of restocking new product into vending machines. The invention can incorporate an additional feature of a prior art kicker and can provide additional marketing information for the consumer.

While the invention has been particularly shown and described with reference to a preferred embodiment, it will be understood by those skilled in the art that various changes in form and detail may be made therein without departing from the spirit and scope of the invention.

What is claimed is:

1. An information panel attachable to a spiral of a vending machine, said information panel comprising:

a curvilinear convex channel forming a partial circumferential surface, the convex surface of said curvilinear convex channel is oriented on the interior circumference of the partial circumferential surface formed by the curvilinear channel for attaching said information panel to a vending machine spiral; and a graphics surface extending from the interior circumference of the partial circumferential surface formed by said curvilinear convex channel and integral to said curvilinear convex channel such that said graphics surface is in approximately the vertical plane and facing outward towards a consumer using a vending machine when said information panel is attached by way of nesting the exterior circumference of said curvilinear convex channel to the surface of a spiral of said vending machine.

2. The information panel of claim 1 further comprising:

a lip integral to and extending from said curvilinear convex channel, said lip oriented approximately perpendicular to said graphics surface.

3. The information panel of claim 1 wherein the width of the integral interface between the graphics surface and the convex channel is less than the width of the graphics surface.

4. A device attachable to a vending machine spiral, said device comprising:

a curvilinear convex channel forming a partial circumferential surface, the convex surface of said curvilinear convex channel is oriented on the interior circumference of the partial circumferential surface formed by the curvilinear channel;

a panel attached to and extending from the interior circumference of said curvilinear convex channel;

wherein the exterior circumference of said curvilinear convex channel is attachable to a vending machine spiral and further wherein said panel provides a vertical graphics surface when said curvilinear convex channel is attached to such spiral.

5. The device of claim 4 wherein said convex channel and said panel comprise an integral piece.

6. The device of claim 5 wherein the width of the integral interface between the panel and the convex channel is less than the width of the panel.

7. The device of claim 4 further comprising a kicker attached to and extending from said convex channel, wherein said kicker is approximately perpendicular to said panel.

* * * * *